United States Patent [19]

Federle et al.

[11] Patent Number: 4,865,051

[45] Date of Patent: Sep. 12, 1989

[54] APPARATUS FOR THE CONTINUOUS DETERMINATION OF TWO PHYSICAL PROPERTIES OF THE CONSTITUENTS OF A SMOKABLE ARTICLE

[75] Inventors: Hartmut Federle, Ahrensburg; Meinhard Meyer, Appen-Unterglinde; Jörn Ulrich, Bönningstedt; Friedrich Walther, Bargteheide; Friedrich Weinhold, Norderstedt, all of Fed. Rep. of Germany

[73] Assignee: B.A.T. Cigarettenfabriken GmbH, Hamburg, Fed. Rep. of Germany

[21] Appl. No.: 174,913

[22] Filed: Mar. 29, 1988

[30] Foreign Application Priority Data

Apr. 2, 1987 [EP] European Pat. Off. ..... 87104882

[51] Int. Cl.[4] ..... A24C 5/18; A24C 5/34

[52] U.S. Cl. ..... 131/84.1; 131/280; 131/904; 131/906; 131/908

[58] Field of Search ..... 131/280, 84.1, 906, 131/84.4, 904, 908

[56] References Cited

U.S. PATENT DOCUMENTS

| | | | |
|---|---|---|---|
| T941,011 | 2/1975 | Morrison et al. | 131/280 |
| 2,667,172 | 1/1954 | Broekhugsen | 131/84.1 |
| 3,411,513 | 11/1968 | Knobel | 131/280 |

FOREIGN PATENT DOCUMENTS

| | | | |
|---|---|---|---|
| 1166069 | 10/1964 | Fed. Rep. of Germany | 131/280 |
| 1902954 | 8/1970 | Fed. Rep. of Germany | 131/280 |
| 2241774 | 3/1974 | Fed. Rep. of Germany | 131/280 |
| 2332384 | 1/1975 | Fed. Rep. of Germany | 131/84.1 |
| 2457141 | 6/1975 | Fed. Rep. of Germany | 131/280 |
| 3204342 | 5/1985 | Fed. Rep. of Germany | 131/280 |
| 982001 | 2/1965 | United Kingdom | 131/280 |
| 1588506 | 4/1981 | United Kingdom | 131/84.1 |
| 2153654 | 8/1985 | United Kingdom | 131/84.1 |

*Primary Examiner*—V. Millin

*Attorney, Agent, or Firm*—Armstrong, Nikaido, Marmelstein, Kubovcik & Murray

[57] ABSTRACT

An apparatus for the continuous determination of two physical properties of the constituents of a smokable article from the mechanical properties of a rod of tobacco or filter fibres during the production of said rod employs a format finger for compacting the rod of tobacco or filter fibres to a predetermined diameter; the format finger made from hard metal comprises at a first point, at which the diameter of the rod corresponds substantially to the diameter of the finished rod, at least one opening for subjecting the rod to a gas stream; the one or each opening is connected via a critically traversed nozzle in a supply conduit to a gas source; a measuring-value transducer determines the pressure drop of the gas stream with constant volume occurring at the rod and thus the draw resistance. At a second point of the format finger a transducer of the temperature of the format finger caused by the friction heat at a predetermined conveying speed of the rod is disposed in a blind bore; said temperature represents a measure for the hardness of the smokable article.

22 Claims, 2 Drawing Sheets

APPARATUS FOR THE CONTINUOUS DETERMINATION OF TWO PHYSICAL PROPERTIES OF THE CONSTITUENTS OF A SMOKABLE ARTICLE

BACKGROUND OF THE INVENTION

1. Field of the Invention

The invention relates to an apparatus for the continuous determination of two physical properties of the constituents of a smokable article from the mechanical properties of a rod of tobacco or filter fibres during the manufacture of said rod, comprising a format finger for compacting the rod to a predetermined diameter.

2. Description of the Prior Art

For the quality control in cigarette manufacture, ever increasing attention is being paid to the hardness of the cigarettes and filters because it can be determined in relatively simple manner from a hardness measurement whether or not a smokable article, for example a cigarette, is adequately filled. And it is precisely the defective filling of smokable articles which is a frequent reason for complaint.

Consequently, in an article from "*Beitrage zur Tabakforschung*", Volume 4, No. 7, December 1968, a device for testing the hardness of cigarettes is described, in which the diameter change of cigarettes under a specific load is measured after a predetermined time and the hardness derived therefrom. However, this practically static method is suitable only for random checks and therefore cannot be employed for the everyday, continuous monitoring of the hardness of the smokable article during the production and for the corresponding control of the entire production.

In addition, U.S Pat. No. 3,411,513 discloses a method in which a moving, finished tobacco rod sheathed in paper is deformed by an air stream and the associated follow-up of the nozzle is detected. The occurring movement of the nozzle is related to the filling force of the tobacco and thus to the hardness of the cigarette. The obtained information, however, is influenced by diameter fluctuations and the porosity of the cigarette paper; consequently only in a few cases is there an exact correlation with the static measurement of the hardness by the determination of the penetration depth, as known from this article.

Furthermore, various methods are known in which the deformation of the format finger under the influence of the flow of tobacco fibres therealong is detected and thus a continuous measurement signal is obtained which is supposed to be in correlation with the hardness of the finished cigarette. Thus, German Offenlegungsschrift 22 41 774 discloses an apparatus in which a force transducer, generally a strain gauge, is provided which detects the deformation of the support bridge for the format finger. Another variant is known from German Offenlegungsschrift 24 57 141 in which the deflection of the front portion of the two-part format finger under the action of the rod of tobacco fibres is determined. Finally, U.S. Pat. No. 2,667,172 discloses an apparatus which detects at various points the vertical and horizontal forces which the tobacco rod exerts on its guide and in particular on the format finger. Thus, for example, the width of the gap between the front end of the format finger and a transducer is detected, i.e. the deflection of the front end of the format finger.

German patent 32 04 342 discloses an apparatus for measuring the compressibility of tobacco within a tobacco stream transported on a continuously driven conveyor wherein at least two rollers disposed in series in the conveying direction are applied to the tobacco stream; considered in the conveying direction, the downstream roller exerts a greater pressure action on the stream than the upstream roller; associated with the rollers are transducers, for determining the magnitude of the deformations of the tobacco stream produced by the rollers; the outputs of said transducers are connected to an evaluation circuit for forming from said parameters a function providing a measure of the compressibility of the tobacco. Thus, in this manner the compressibility is determined by comparison measurement at two different points along the processing path of the rod at which said rod has different heights or is subjected to different pressure forces.

However, in apparatuses of the type according to U.S. Pat. No. 3,411,513, German Offenlegungsschrift 22 41 774, German Offenlegungsschrift 24 57 141 and U.S. Pat. No. 2,667,172, the result of the measurement correlates linearly with the hardness of the finished cigarette only when the deformation of the format finger is detected at the location where the diameter of the rod of tobacco fibres corresponds substantially to the tobacco diameter of the finished smokable article as is known from German Offenlegungsschrift 33 06 538; although not expressly mentioned therein, this fact is also implemented substantially in the final result for the apparatus according to the German Offenlegungsschrift 24 57 141.

Furthermore, in the quality control of cigarettes the draw resistance of the cigarette is of great importance because from a draw resistance measurement, it is possible to determine in relatively simple manner whether a cigarette permits the desired draw volume. The draw volume of a cigarette in turn is governed firstly by the manner in which the smoker smokes the cigarette and secondly by its draw resistance which is constituted by the draw resistance of the tobacco rod and of the filter.

Thus, to always ensure for the smoker of a given brand cigarette the same draw volume—keeping the subjective parameter, that is the manner in which the smoker smokes the cigarette, constant—the draw resistance must be kept to a fixed value.

To ensure that this constant draw resistance value is maintained individual cigarettes are taken in random checks from the everyday production and their draw resistance determined with a device as described, for example, in the article "The Measurement of Smoking Parameters with the Aid of Parameter Converters", published in "*Beitrage zur Tabakforschung*", Volume 6, No. 1, July 1971. In this method the cigarette is connected by means of a rubber lip to a smoking machine which, for example, draws a gas flow with constant volume through the cigarette. In accordance with the usual standardization, the constant flow volume at the exit side should be 17.5 $cm^3$/sec.

Due to the flow resistance of the cigarette a pressure drop occurs between the entry side and exit side of the gas flow and is referred to as "draw resistance"; it can be measured by a pressure transducer.

Alternatively, it is fundamentally also possible with constant pressure drop to measure the gas volume passing through the cigarette.

These apparatuses are, however, only suitable for carrying out random checks, i.e. cannot be used for the everyday continuous measurement of the draw resistance of all cigarettes, for example those made by a certain cigarette machine, because each cigarette must be inserted into the apparatus and measured individually. These random checks can only be carried out at predetermined intervals of time so that in general it is not possible to react immediately to a detected change of the draw resistance of the cigarette by appropriate regulation of the production cycle.

British Pat. No. 1,588,506 discloses an apparatus for measuring the draw resistance of a rod of filter fibres with which the pressure drop at the rod is detected in a region at which the rod has reached almost its final cross-section. The intention is to detect the pressure drop at a location downstream from the smallest cross-section of the rod of filter material because there the filter fibres have reached their final position and thus can no longer be displaced by the air passing through the rod. The main compression of the rod is by means of a wheel whilst the shaping and subsequent compression is carried out by a format finger which is arranged in the movement direction of the rod downstream from the wheel.

A further aparatus for measuring the draw resistance of a rod of tobacco fibres is disclosed in German Auslegeschrift 11 66 069 and comprises a source for a gas flow passing through the rod and a measuring-value transducer for determining the pressure drop of the gas flow with constant gas volume occurring at the rod or of the gas volume with constant pressure drop passing through the rod. A pump passes the air through the tobacco flow into an enclosed space of constant volume which is formed between a trough through which the format belt draws the tobacco stream and a member opposite said trough, for instance a pressure shoe or a tongue as known per se.

Admittedly, this permits the continuous measurement of the draw resistance of a rod of tobacco fibres; the value determined is also specific for the rod of tobacco fibres so that the draw resistance determined can be used for process control. A disadvantage, however, is that the draw resistance of the rod of tobacco fibres thus determined does not correlate with the draw resistance of the finished cigarette which is a very important product parameter because it is an essential characteristic of a specific cigarette type.

SUMMARY OF THE INVENTION

The invention is therefore based on the problem of providing an apparatus for the continuous determination of the two essential physical properties, i.e. the hardness and draw resistance, of a smokable article from the mechanical properties of a rod of tobacco or filter fibres during the production of said smokable article of the type referred to in which the aforementioned disadvantages are obviated.

In particular, an apparatus is to be proposed providing measuring values for the hardness on the one hand and the draw resistance on the other hand which correlate in exactly defined manner with the hardness and draw resistance of the finished smokable article made from said tobacco or filter rod.

The invention therefore proposes an apparatus for the continuous determination of two physical properties of the constituents of a smokable article from the mechanical properties of a rod of tobacco or filter fibres during the production of said rod, comprising a format finger for compacting the rod to a predetermined diameter, the improvement being that the format finger made from hard metal comprises at a first location at which the diameter of the rod corresponds approximately to the diameter of the finished rod at least one opening for subjecting the rod to a gas stream; the one or each opening is connected via a critically traversed nozzle in a supply conduit to a gas source; a measuring-value transducer determines the pressure drop of the gas stream with constant volume occurring at the rod and at a second location of the format finger a transducer for the temperature of the format finger caused by the friction heat at a predetermined conveying speed of the rod is disposed in a blind bore.

Expedient embodiments are defined by the features of the subsidiary claims.

The advantages achieved with the invention are based on the fact that in a manner simple to implement two measured values are obtained which correlate very exactly with the hardness and the draw resistance of the finished smokable article so that deviations of said measured values from a predetermined desired value pair are an indication of production problems which can be remedied immediately by means of an appropriate control.

The mode of operation will be explained in detail with reference to the example of the continuous manufacture of cigarettes. In the manufacture of cigarettes the tobacco stream coming from a distributor is conveyed in an air flow to a perforated suction belt, thereby forming a continuous tobacco rod. At so-called "trimmer discs" this tobacco rod is brought in a weight-controlled machine to its desired weight and transferred with the aid of the suction belt to a transfer station. At the latter the tobacco rod, which is not yet compacted at this instant, is taken over by a format belt which is covered with the cigarette paper. In a following format finger the tobacco rod, which has a substantially circular cross-section, is continuously compacted from the diameter present there of about 11 mm to a diameter of about 6.8 mm. This compacting of the tobacco rod beyond the diameter of the finished cigarette, which is about 8 mm, is necessary for the sheathing of the tobacco rod with the cigarette paper which starts at the end of the format finger.

This sheathing of the tobacco rod with the cigarette paper is effected by lateral creation of the format belt, the one end of the cigarette paper projecting out of said format means and being provided with a glue layer. In a subsequent heating device the glued end of the cigarette paper is folded over and glued. The endless rod sheathed with the cigarette paper thus produced passes through a diameter inspection means is then cut to the desired cigarette length.

At a point of the format finger, whose position depends on the length of the format finger and its inclination, the diameter of the compacted rod is about 7.85 mm, i.e. equal to the diameter of the finished cigarette but without the double thickness of the cigarette paper.

It has now been found by investigations that the pressure drop of a gas stream of constant volume introduced into the compacted tobacco rod beneath the format finger at a location at which the tobacco rod has a diameter of about 7.85 mm correlates very exactly with the pressure drop in the finished cigarette, i.e. represents an exact reproduceable measure of the draw resistance of the finished cigarette.

Thus, if in cigarette manufacture the tobacco rod is subjected at this location to a gas stream of constant volume and the corresponding pressure drop occurring at the tobacco rod is measured, it is possible to calculate in the usual manner from the pressure drop the draw resistance of the cigarettes which are made from this tobacco rod in the course of the further processing.

Even slight fluctuations of the draw resistance can therefore be immediately detected during the production and used, for example, for controlling the production cycle.

If the gas stream is supplied to the opening in the format finger via a "critically traversed nozzle", i.e. a nozzle which the gas flow leaves with critical velocity, an extremely constant flow volume is obtained as is necessary for the exact determination of the pressure drop at the rod. The critically traversed nozzle is able to furnish the constant gas volume independent of any possible counter-pressure which could occur.

The usual format fingers made from hardened steel are not suitable as "sensor base" because firstly the configuration of the opening(s) desired and still to be explained becomes problematical and secondly these format fingers cannot withstand the loads occurring. In particular, the formation of a plurality of openings in the format finger leads to a reduction of the mechanical strength so that format fingers of hard metal are used, i.e. alloys made by compacting and sintering and having great hardness on the basis of carbides, as sold for example under the trade mark "WIDIA".

For detecting the pressure drop at the rod, the usual pressure transducers may be used which are suitable for measuring gaseous media and have a suitable measuring range.

The pressure transducers or sensors should be arranged in the rod axially with respect to the influx direction of the gas stream so that even brief density fluctuations of the rod leading to a change in the pressure drop and generating a pressure wave in the gas flow can be detected and taken into account.

If the draw resistance must be determined over a somewhat greater rod length, the pressure transducer should be arranged perpendicularly to the influx direction of the gas stream into the rod. It is also possible to arrange the pressure transducer outside the actual machine area.

The form, size and number of openings in the format finger, through which the rod is subjected to the gas stream, depend on the constructional form of the format finger and on the properties of the rod, in particular on the difference tobacco rod/filter rod.

It must, however, also be ensured that the edges of the opening do not obstruct smooth jerk-free movement of the rod and also favourably influence the influx of the gas into the rod. This can be achieved if the entry region of the opening in the format finger is formed similar to a diffuser or a nozzle, in particular of the Venturi or Laval nozzle type.

Further influencing of the influx behaviour is possible by appropriate selection of the entry direction of the gas stream into the rod.

The volume flow occurring depends on the one hand on the area of the opening(s) and on the other on the properties of the tobacco rod. Thus, even a slight increase in the volume flow can lead to a large pressure drop. Thus, by appropriate setting of the volume flow, pressure-drop values can be obtained which are very well suited for signal amplification as often necessary in the control of the production cycle.

Pressure transducer or sensors available commercially furnish the measuring value for the pressure drop at the rod directly as electrical signal which can be used for the control of the cigarette manufacture from the point of view of maintaining a constant draw resistance.

In the immediate vicinity of said sensor for the draw resistance, the hardness sensor is arranged which is formed by a temperature transducer as already known in principle from German patent 34 04 635. These two sensors may be arranged directly adjacent each other so that they scan practically the same points on the tobacco rod and therefore ensure that in a control of the cigarette manufacture by means of the output signals of these two sensors, immediate response and appropriate counter measures are possible.

BRIEF DESCRIPTION OF THE DRAWINGS

The invention will be explained hereinafter in detail with the aid of an example of embodiment for the manufacture of a rod of tobacco fibres with reference to the attached schematic drawings, wherein.

DESCRIPTION OF THE PREFERRED EMBODIMENT

Figure 1:
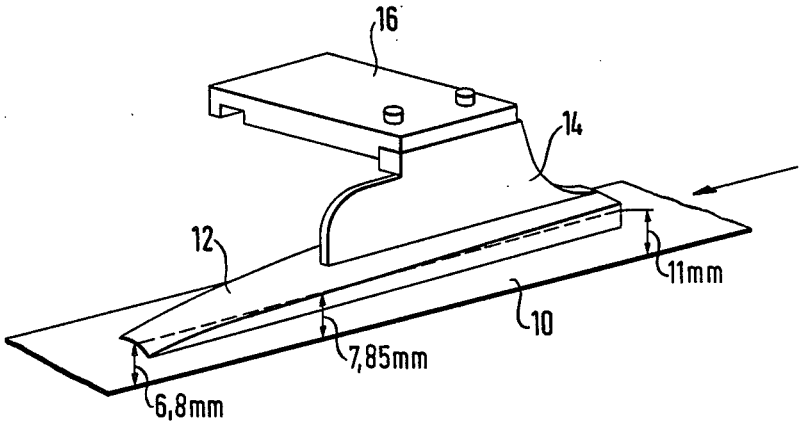
FIG. 1 is a perspective view of the format finger and of the format belt of a cigarette machine.

FIG. 1 shows the part of a conventional cigarette machine in which the substantially cylindrical tobacco rod transported in the direction of the arrow and having a diameter of about 11 mm is compacted to the diameter of about 6.8 mm. The transported tobacco rod lying on a format belt 10 is compacted by a format finger 12, having substantially the form of a hollow semicylinder, to the desired diameter. As apparent in FIG. 1 the format finger 12 is mounted on a vertically arranged, relatively rigid plate 14 which in turn is attached to a horizontal support 16.

Figure 2:
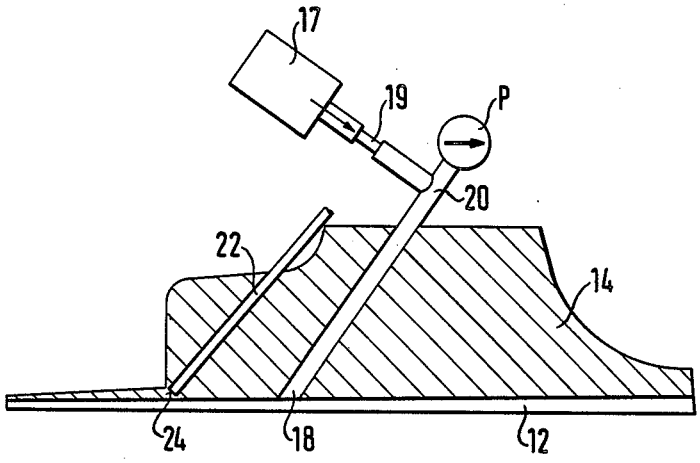
FIG. 2 is a section through the format finger with the two sensors for the measurement of the hardness and draw resistance and FIG. 3 is a plan view of the format finger with the two sensors.
Figure 3:
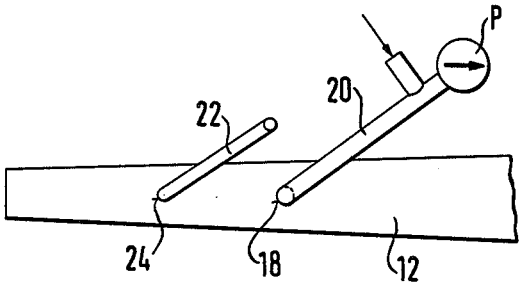

FIGS. 2 and 3 show an embodiment of an apparatus or device for the continuous measurement of the draw resistance and the hardness of this tobacco rod which is provided on the format finger 12; if it is assumed that the tobacco rod at the entrance into the format finger 12 has a diameter of 11 mm and at the exit a diameter of 6.8 mm, then at the location indicated in FIG. 1 a spacing results between the format (not shown) and format finger 12 which amounts to 7.85 mm. Due to the lateral restriction of the tobacco rod by the format belt 10 covered with cigarette paper and the format finger 12, a compacting density arises at this location which corresponds to the compacting density of the finished cigarette. Such a finished cigarette has a diameter of the tobacco rod of 7.85 mm and a paper thickness of about 0.1 mm.

Now, if the format finger is formed at the location, at which the tobacco rod has diameter of 7.85 mm, with a continuous opening 18, through which a gas stream of constant volume flows which is supplied in the direction of the arrow from a source 17 of constant pressure via a hose or conduit 20 with a critical flow orifice or nozzle 19, the flow resistance of the rod results in a pressure drop of the gas stream which can be detected by a conventional pressure P connected to the hose or conduit 20.

In this embodiment the hose or conduit 20 for introducing the gas stream into the opening 18 of the format finger 12 is disposed in the front part of the rigid plate 14 and extends in slight deviation from the perpendicular to the format finger 12 and thus to the conveyed tobacco rod, that is at an angle of about 80° to 83° to the tobacco rod. It is, however, also possible to operate with somewhat greater deviations from the perpendicular, at about an angle of 70° to 87°, in particular 78° to 85°.

Due to this slight inclination of the supply direction with respect to the tobacco rod, the opening 18 is given a circular or ellipsoidal form depending on the requirement.

In addition, the opening 18 should be designed so that firstly it does not influence the influx of the gas stream and secondly does not interfere with the transport of the tobacco rod. In particular, it is expedient to round the edges of the opening 19 lying on the tobacco rod to avoid disturbing the satisfactory conveyance of the tobacco rod.

Furthermore, the inlet region of the opening should be formed similarly to a diffuser or a nozzle, in particular of the Venturi or Laval type.

The area of the opening 18 in the format finger should have a size of 0.5 to 12.0 $mm^2$, in particular 0.6 to 2.0 $mm^2$, since with smaller opening areas the pressure drop deviates greatly. With larger areas disturbances in the entry region may occur. Good results were obtained with an area of 0.8 $mm^2$.

The constant volume of the gas stream can be varied in the range from 4 to 600 ml/s, in particular between 8 and 140 ml/s, without appreciable deviations from the desired correlation with the static draw resistance measurement occurring.

If required, several openings 18 can be provided in the format finger 12, thereby making possible, for example, formation of a mean value for the draw resistance.

Finally, the draw resistance can also be determined from the variable volume under constant pressure drop at the rod, the source of the volume flow being set such that the pressure drop is kept to a predetermined value. The pressure transducer P must then be replaced by a volume meter.

It is possible with this sensor to carry out a control of the cigarette manufacture for continuous draw resistance, conveniently via the tobacco insert weight, i.e. controlling the position of the trimmer discs.

In addition, a temperature transducer 22 is mounted on the format finger 12, i.e. a thermoelement, a semiconductor temperature sensor or a resistance thermometer. The temperature transducer 22 is likewise mounted substantially at the location of the format finger 12 at which the diameter of the tobacco rod corresponds to that of the finished cigarette.

As apparent from FIG. 2, at this location the format finger is provided with a blind bore 24 which extends from the upper side of the format finger 12 downwardly up to the vicinity of its lower face, the remaining wall thickness being about 0.1 mm. The actual measuring point of the temperature transducer 22 is inserted into said blind bore 24.

FIG. 3 shows a plan view of this measuring arrangement with the blind bore 24, the temperature transducer 22, the hose or conduit with the through opening 18 in the format finger 12 and the pressure transducer P.

The return force of the tobacco rod against the compacting exerted by the format finger 12, and thus the friction forces between tobacco rod and format finger 12 and therefore finally the temperature generated by said friction forces correlate very exactly with the return force of the finished smokable article, for example a cigarette, so that the temperature of the format finger 12 at this point furnishes an exact reproduceable measure of the hardness of the finished cigarette.

If required the electrical signals generated by one of the two transducers 22 and P for the hardness and draw resistance can be combined with an electrical signal for the moisture which is furnished, for example by a moisture meter installed in the spreader of the rod producing machine; it is thus possible to obtain moisture-corrected values for the hardness and the draw resistance. This is necessary because, as is known for different tobacco moisture and for otherwise the same conditions, the properties in particular the cigarette hardness, can fluctuate.

The output signals of the two transducers 22 and P can be used directly for controlling the cigarette manufacture, in particular for adjusting the trimmer discs in dependence upon the determined actual values and for comparison with predetermined desired values.

We claim:

1. Apparatus for the continuous determination of the draw and hardness of a rod shaped smokable article by monitoring physical properties of the article during production of the article comprising:
   - a format finger for compacting the rod to a predetermined diameter, said format finger being made from hard metal and including at least one opening for subjecting the rod to a gas stream at a first location where the diameter of the rod corresponds approximately to the diameter of the finished article,
   - a gas source,
   - a supply conduit connecting said gas source to said at least one opening,
   - a critical flow orifice providing a constant volume of gas flow in said conduit,
   - a pressure transducer for measuring the pressure drop at said at least one opening,
   - a blind bore in said format finger at a second location, and
   - a temperature transducer in said blind bore for measuring the temperature of the format finger caused by friction between the rod and the format finger as the rod is conveyed relative to the format finger,
   - whereby the draw and hardness of a rod shaped smokable article may be determined by monitoring said pressure drop and temperature respectively.

2. An apparatus according to claim 1, wherein the opening has a circular or ellipsoidal form.

3. An apparatus according to claim 1, wherein the edges of the opening are shaped favorable for flow.

4. An apparatus according to claim 3, wherein the entry region of the opening is formed as diffuser or nozzle.

5. An apparatus according to claim 4, wherein the entry region of the opening is formed as a Venturi or Laval nozzle.

6. An apparatus according to claim 3, wherein the edges of the opening contacting the rod are rounded.

7. An apparatus according to claim 1, wherein the gas stream through the opening impinges on the rod at an angle of between 70° and 87°.

8. An apparatus according to claim 7, wherein said gas stream impinges on said rod at an angle of between 78° and 85°.

9. An apparatus according to claim 1, wherein the pressure drop of the gas stream with constant volume at the rod is measured in supply conduit of the gas stream.

10. An apparatus according to claim 9, wherein the pressure transducer is arranged in a supply conduit axially with respect to the entry direction of the gas stream into the rod.

11. An apparatus according to claim 1, wherein the format finger includes a plurality of openings which are subjected to gas flows of different volume.

12. An apparatus according to claim 11, wherein the openings have different shapes.

13. An apparatus according to claim 1, wherein the area of an opening in the format finger is between 0.5 and 12 $mm^2$.

14. An apparatus according to claim 13, wherein the area of an opening in the format finger is between 0.6 and 2 $mm^2$.

15. An apparatus according to claim 1, wherein the constant volume of the gas stream is between 4 and 600 ml/s.

16. An apparatus according to claim 15, wherein the constant volume of the gas stream is between 8 and 140 ml/s.

17. An apparatus according to claim 1, wherein the temperature transducer is a resistance thermometer.

18. An apparatus according to claim 1, wherein the temperature transducer is a thermocouple.

19. An apparatus according to claim 1, wherein the temperature transducer is a semiconductor temperature sensor.

20. An apparatus according to claim 1, wherein the temperature transducer is located in the format finger in a region where the diameter of the rod corresponds substantially to the diameter of the finished article.

21. An apparatus according to claim 20, wherein the distance between the end of the blind bore and a surface of the format finger contacting the rod is as small as possible.

22. An apparatus according to claim 1, wherein the blind bore extends from the upper side of the format finger in a direction toward the rod shaped smokable article.

* * * * *